US007192103B2

(12) United States Patent
Hamilton

(10) Patent No.: US 7,192,103 B2
(45) Date of Patent: Mar. 20, 2007

(54) SPRING LOADED BRACKET ASSEMBLY HAVING A TOOL-LESS ATTACHMENT AND REMOVAL FEATURE

(75) Inventor: Scott L. Hamilton, Lake Forest, CA (US)

(73) Assignee: Ergo 2000, Inc., Fullerton, CA (US)

( * ) Notice: Subject to any disclaimer, the term of this patent is extended or adjusted under 35 U.S.C. 154(b) by 330 days.

(21) Appl. No.: 10/623,909

(22) Filed: Jul. 21, 2003

(65) Prior Publication Data

US 2004/0016712 A1 Jan. 29, 2004

Related U.S. Application Data

(60) Provisional application No. 60/397,364, filed on Jul. 19, 2002.

(51) Int. Cl.
*A47B 88/00* (2006.01)

(52) U.S. Cl. ..... 312/334.5; 312/334.4; 312/319.1; 211/175; 248/222.11

(58) Field of Classification Search ..... 312/334.4, 312/334.5, 334.8, 319.1, 334, 223.1, 265, 312/265.1, 350; 211/26, 103, 175, 190, 191; 248/220.1, 221.11–12, 222.11–12, 161, 408, 248/241; 361/725, 727, 825, 829
See application file for complete search history.

(56) References Cited

U.S. PATENT DOCUMENTS 5,833,337 A * 11/1998 Kofstad ..... 312/334.5
6,230,903 B1 * 5/2001 Abbott ..... 211/26
6,273,534 B1 * 8/2001 Bueley et al. ..... 312/334.8
6,442,030 B1 * 8/2002 Mammoser et al. ..... 361/727
6,578,939 B1 * 6/2003 Mayer ..... 312/334.5
6,659,577 B2 * 12/2003 Lauchner ..... 312/334.5
6,948,691 B2 * 9/2005 Brock et al. ..... 211/175
6,976,745 B2 * 12/2005 Dobler et al. ..... 312/334.44

FOREIGN PATENT DOCUMENTS

GB 2184345 * 6/1987

* cited by examiner

*Primary Examiner*—Lanna Mai
*Assistant Examiner*—Hanh V Tran
(74) *Attorney, Agent, or Firm*—Klein, O'Neill & Singh, LLP; Howard J. Klein

(57) ABSTRACT

A bracket assembly for attaching a slide track to a rail of an equipment rack without the need for tools comprises a longitudinal main portion, a first or interior surface of which provides a mounting surface for the slide track, and an attachment portion that is substantially perpendicular to the main portion, and that is configured to seat against the rail. A quick-release latching assembly, including a latch element, is slidably mounted on a second, or exterior, surface of the main portion of the bracket assembly adjacent to the end portion, and is movable between a first position, in which the latch element is in a locking engagement with the rail, and a second position in which the latch element is disengaged from the rail. The latching assembly is coupled to the main bracket portion by a biasing element, such as a spring or an elastic band, that biases the latching assembly toward the first position.

16 Claims, 8 Drawing Sheets

SPRING LOADED BRACKET ASSEMBLY HAVING A TOOL-LESS ATTACHMENT AND REMOVAL FEATURE

CROSS-REFERENCE TO RELATED APPLICATIONS

This application claims benefit under 35 U.S.C. Section 119(e) of co-pending provisional patent application Ser. No. 60/397,364, filed Jul. 19, 2002.

FEDERALLY-SPONSORED RESEARCH OR DEVELOPMENT

Not Applicable

BACKGROUND OF THE INVENTION

1. Field of the Invention

This invention relates, in general, to mounting brackets for equipment racks, and more specifically, to a resiliently biased bracket assembly having a "tool-less" attachment and removal feature, i.e., one which can be attached to and removed from an equipment rack without the use of tools or implements.

2. Description of Related Art

Conventional equipment racks for holding, e.g., computer or telecommunication equipments, typically employ an arrangement of vertical rails, usually one in each interior corner thereof. The racks usually include several shelves that are slidably mounted in a pair of opposing slide tracks, each of which, in turn, is attached to a front and a rear rail on a respective side of the rack by means of a mounting bracket.

One drawback of conventional mounting brackets is that their attachment to, and removal from, an equipment rack rail requires the use of one or more tools. For example, when a mounting bracket is to be attached to a rail, a tool, such as a screwdriver or a wrench, is needed to tighten a screw or bolt installed through the bracket into a threaded receptacle attached to the rail. The need to use a tool is inconvenient, burdensome, and time-consuming. In addition, once the mounting bracket is secured to the rail, removal or adjustment of the bracket also requires the use of tools to remove and re-attach the bracket to the rail.

A need therefore exists for a bracket that can be attached to and removed from a rail without the use of tools, and preferably, using only one hand.

BRIEF SUMMARY OF THE INVENTION

In accordance with the present invention, a bracket assembly is provided for attaching a slide track to a rail of an equipment rack. In a first exemplary embodiment thereof, the bracket assembly comprises a longitudinal main portion, a first or interior surface of which provides a mounting surface for the slide track, and an end or attachment portion that is substantially perpendicular to the main portion, and that is configured to seat against the rail. A latching assembly, including a latch element, is slidably mounted on a second, or exterior, surface of the main portion of the bracket assembly adjacent to the end portion, and is movable between a first position, in which the latch element is in a locking engagement with the rail, and a second position in which the latch element is disengaged from the rail. The latching assembly is coupled to the main bracket portion by a biasing element, such as a spring or an elastic band, that biases the latching assembly toward the first position.

The end portion of the bracket is configured with at least one tab that is engagable with the rail through one of the apertures provided in the rail for the attachment of the brackets. The latch element also includes an outwardly extending latch projection that is configured to enter the rail aperture and abut against the end portion of the bracket assembly when the latching assembly is in the first position. The latch projection includes a tapered leading edge defining a camming surface. When the end portion of the bracket is pushed into position over one of the rail apertures, the engagement between the rail and the leading edge of the latch projection forces the latching assembly from its first position to its second position and against the biasing force provided by the biasing element. This enables the bracket assembly to be snapped into place, and when the projection encounters the rail aperture, it springs back to its first position in response to the biasing force applied by the biasing element. Thus, installation of the bracket assembly is accomplished easily and quickly without the need for any tool or implement.

A mechanism is also provided to facilitate the quick and easy removal of the bracket assembly without the need for a tool or an implement. Specifically, a slot is provided near the juncture of the main and end portions of the bracket assembly, and the latching assembly includes a flange that extends through the slot. The flange allows the latching assembly to be moved from its first position to its second position by a person's finger, whereby the latch projection is disengaged from the rail for removal of the bracket assembly.

In a second exemplary embodiment of the invention, the mounting bracket assembly comprises a track assembly, including a pair of elongated, U-shaped, inner and outer tracks, the inner track nesting within the outer track for relative longitudinal telescopic sliding movement, for adjusting the length of the track assembly. Means are provided for clamping the inner track to the outer track at a selected length of the track assembly and thereby prevent relative longitudinal movement between the two tracks. A right-angle flange is disposed on each of a respective one of a rear end of the inner track and a front end of the outer track, and a pair of elongated, axially symmetrical alignment pins are mounted on each of the flanges, with each of the pins being arranged in facing opposition to a corresponding pin on the opposite flange, and with the centers of the pins in respective ones of the pairs being spaced at a distance that is equal to the distance between the respective centers of a first and a third one of a group of three rail apertures. In a preferred embodiment, each alignment pin comprises a pair of stacked, or tandem, concentric cylinders, a smaller one of the cylinders having a conical leading tip and a diameter sized to fit within a small, round, internally threaded rail aperture, and a larger one of the cylinders having a shoulder tapering into the smaller cylinder, and a diameter sized to fit within a large square or round rail aperture.

The mounting bracket assembly further comprises a quick-release latching assembly, including a carrier slidably captivated on the outer track for relative longitudinal sliding movement thereon, and having a right angle flange at first end thereof, as well as means for resiliently urging the flange toward the front end flange of the outer track such that a front rail of the rack is clamped between the two flanges. The mounting bracket further comprises a cam plate slidably captivated on the carrier for relative longitudinal sliding movement thereon, and an elongated latching spring captivated between the cam plate and the carrier for longitudinal sliding movement therebetween. A spring having a first end attached to the carrier and a second end connected to the cam plate is arranged to return the cam plate to a first position relative to the carrier when the cam plate is displaced from that position. The latching spring has a locking tab that is engagable with one of two locking notches in the outer track to prevent longitudinal movement of the carrier on the outer track. The cam plate includes a camming surface that is arranged thereon such that rearward displacement of the cam plate causes the camming surface to engage the locking tab of the locking spring and disengage it from the locking notch, thereby enabling the carrier to move longitudinally on the outer track.

The present invention thus provides a bracket assembly for an equipment rack that can be quickly and easily installed, removed and adjusted without the use of tools or implements. The present invention is readily adaptable to a wide variety of equipment rack configurations, and may be economically manufactured. These and other advantages of the invention will be more readily appreciated from the detailed description thereof that follows.

BRIEF DESCRIPTION OF THE SEVERAL VIEWS OF THE DRAWINGS

Bracket assemblies that implement the various features of the invention will now be described with reference to the drawings. It should be understood that the drawings and the associated descriptions are provided to illustrate exemplary embodiments of the invention, and not as limitations of the scope thereof.

DETAILED DESCRIPTION OF THE INVENTION

The present invention has general applicability to the field of mounting brackets. However, for illustrative purposes, the following description pertains to mounting brackets for equipment racks. To facilitate a complete understanding of the present invention, the remainder of the detailed description describes the present invention with reference to the drawings, wherein like reference numbers are referenced with like numerals throughout.

Figure 1:
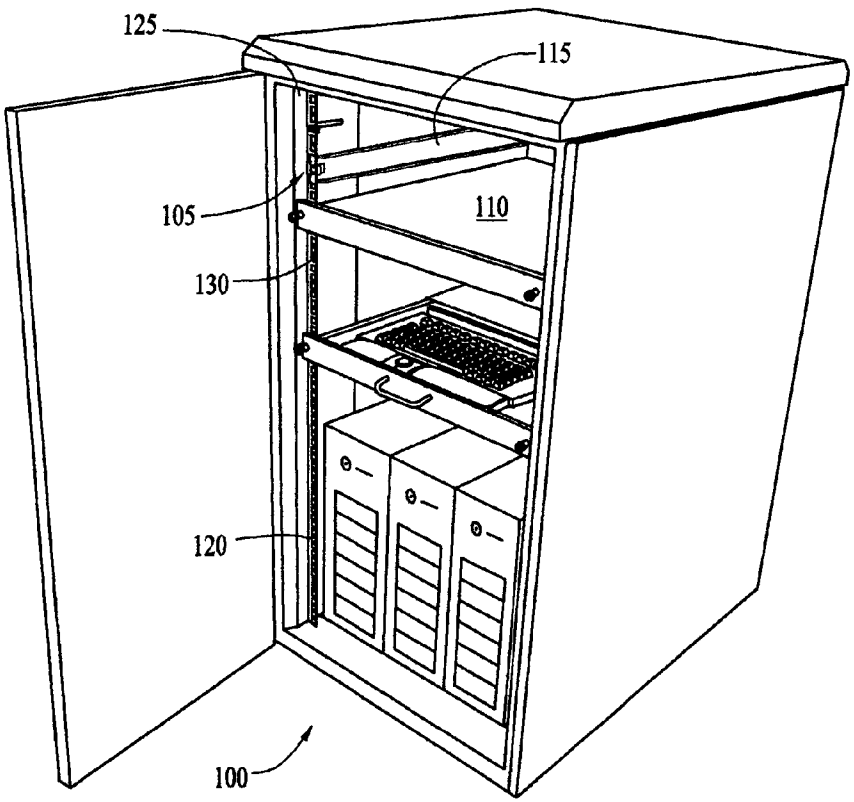
FIG. 1 is a front-and-side perspective view of an equipment rack having a mounting bracket assembly in accordance with a first exemplary embodiment of the present invention.

FIG. 1 is a perspective view of an equipment rack 100 having a bracket assembly 105 according to a first embodiment of the present invention. Each of the bracket assemblies 105 (only one of which is shown) includes an attachment portion, as described in detail below, at each end, and a longitudinal main portion having an interior surface 115 that provides a surface for mounting a slide mechanism (not shown), of conventional design.

The equipment rack 100 also includes a number of shelves 110 having opposed side edges that are configured to slidably engage the slide mechanisms mounted on the bracket assemblies on opposite sides of the rack 100 to enable the shelves 110 to slide in and out of the rack. The shelves 110 are used to hold equipment such as computer monitors, keyboards, and servers, and the slide mechanisms facilitate the movement of the shelves 110 and equipment into and out of the equipment rack 100, in a manner that is well known in the art.

Inside the equipment rack 100, a vertical rail 120 is generally positioned proximate to each interior corner edge 125 of the equipment rack 100 for supporting the shelves 110 and the equipment. (Only one of the four vertical rails 120 is shown in the drawings.) The bracket assemblies 105 may advantageously be adjustable in length so that they can be used with different sized and shaped equipment racks 100. In one embodiment, each rail 120 includes a number of holes or apertures 130. In one exemplary embodiment, the holes 130 are square and about ⅜ inch (9.5 mm) on each side, although the shape and size of the openings 130 can vary while remaining within the spirit and scope of the present invention.

Figure 2:
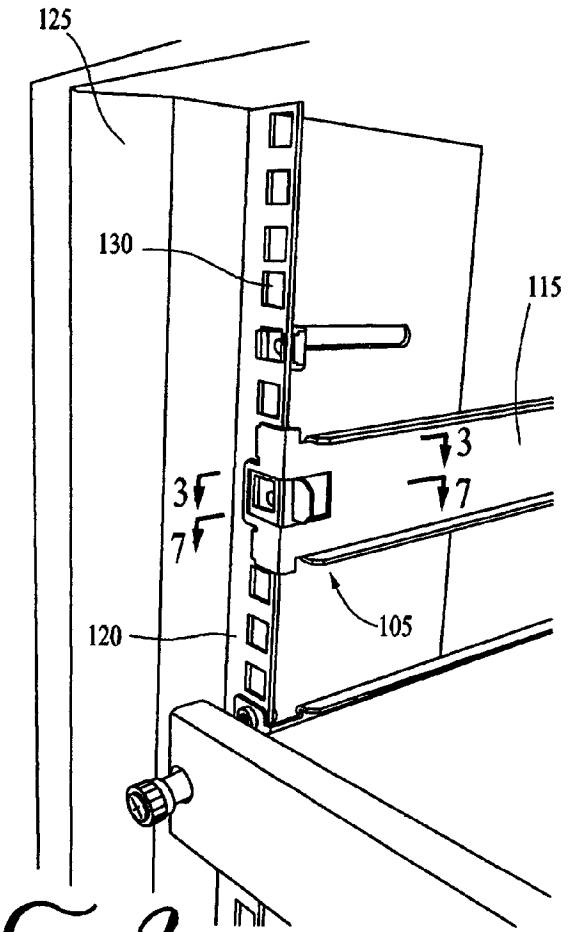
FIG. 2 is an enlarged, partial perspective view of the equipment rack of FIG. 1, showing the first embodiment of the bracket assembly attached to a rail of the rack.

FIG. 2 is a detailed perspective view of a portion of the equipment rack 100 showing the first embodiment of the bracket assembly 105 attached to the rail 120. To attach one shelf 110 to the equipment rack 100, two bracket assemblies 105 and four rails 120 are typically used (also see FIG. 1). Each side of the shelf 110 is attached by means of the slide mechanism to the adjacent bracket assembly 105 to enable the shelf 110 to slide in and out of the equipment rack 100. The slide mechanism may advantageously be of the type that includes ball bearings or other types of low-friction slides (not shown), or it may be one of a number of other types of slide mechanisms that are known in the art.

Figures 3, 4, 5, 6:
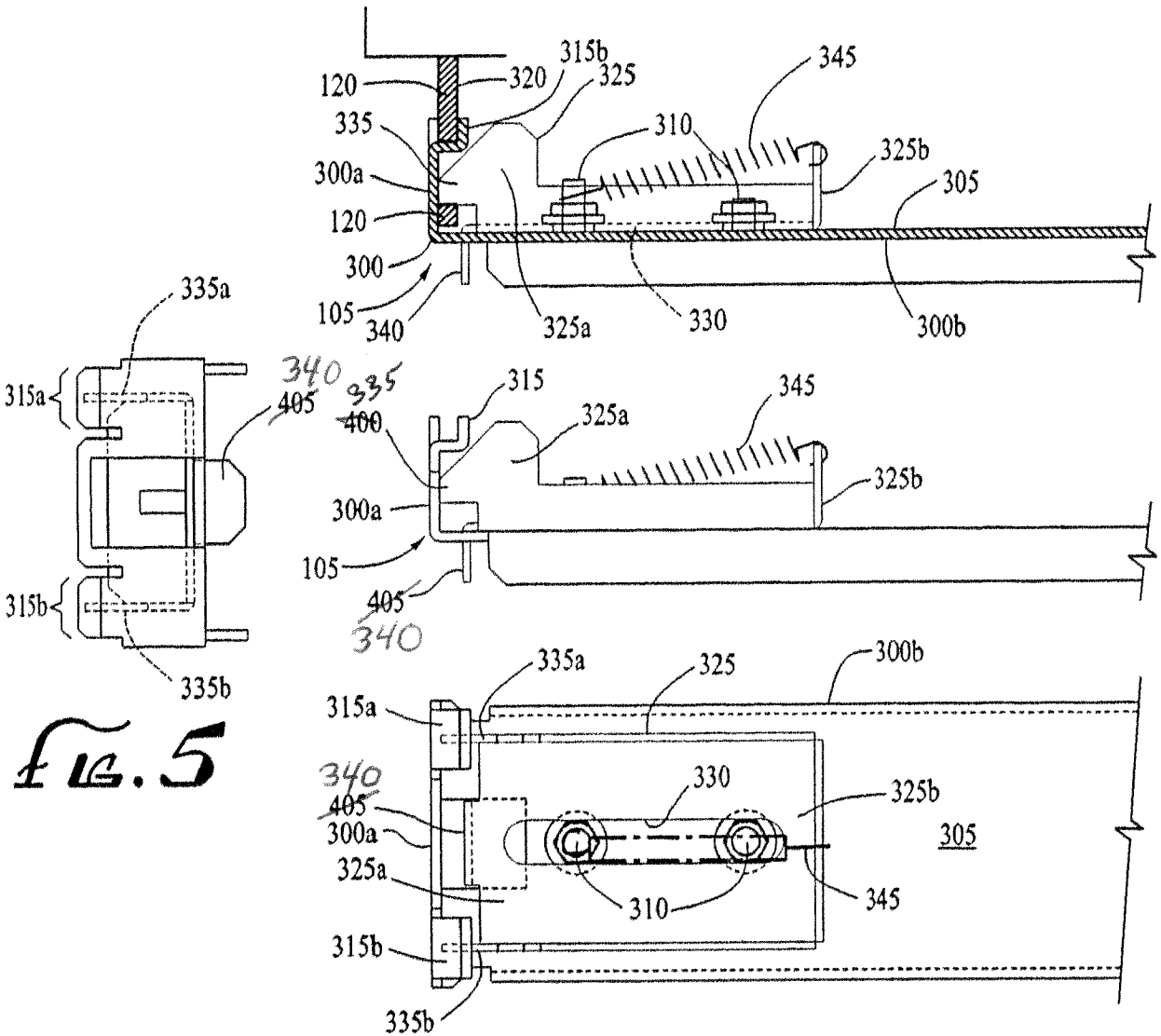
FIG. 3 is a partial cross sectional view of the first embodiment of the bracket assembly attached to the rail, as revealed by the section 3—3 taken in FIG. 2.
FIG. 4 is a partial top plan view of the first embodiment of the bracket assembly.
FIG. 5 is a front elevation view of the first embodiment of the bracket assembly.
FIG. 6 is a side elevation view of the first embodiment of the bracket assembly.

FIG. 3 is a cross-sectional view, as taken along the lines 3—3 in FIG. 2, of the bracket assembly 105 attached to the rail 120. The bracket assembly 105 includes a bracket 300 that may advantageously be made of a durable metal, such as cold rolled steel. The bracket 300 includes an end or attachment portion 300*a*, and a longitudinal main portion 300*b*, wherein the attachment portion 300*a* is integral with, and substantially perpendicular to, the main portion 300*b*. The main portion 300*b* may comprise two telescoping members (not shown), so as to be length-adjustable to fit racks of different sizes. The main portion 300*b* has a flat exterior surface 305 opposite to the interior surface 115, with one or more pegs 310 protruding outwardly therefrom. The end portion 300*a* has a pair of tabs 315*a*, 315*b* that are sized and shaped to fit within two similarly spaced apart openings 130 in the rail 120 so as to engage with a back surface 320 of the rail 120 (also see FIG. 4). In one embodiment, the tabs 315*a*, 315*b* have a stretched "Z" shape. The tabs 315*a*, 315*b* engage the openings 130 to limit the movement of the bracket assembly 105 up and down, as well as forward and backward.

A latching assembly 325 having a first or front end 325*a* and a second or back end 325*b* is slidably mounted on the exterior surface 305 of the main portion 300*b* near the end portion 300*a*. In the embodiment illustrated, the latching assembly 325 may also include an elongated hole 330 that is typically located between the first end 325*a* and the second 325*b* (also see FIG. 6). The elongated hole 330 of the latching assembly 325 is slidably coupled to the one or more pegs 310 of the bracket 300. In one embodiment, the pegs 310 are configured in the shape of a "T" so that the latching assembly 325 can slide along the main portion 300*b* of the bracket 300 without becoming detached from the bracket 300. The pegs 310 are generally positioned along a substantially straight line so that the latching assembly 325 can slide along the main portion 300*b* of the bracket 300 (also see FIG. 6). Even though the pegs 310 and the elongated hole 330 have been described as an exemplary technique for slidably coupling the latching assembly 325 to the bracket 300, other types of such devices as are known to those of ordinary skill in the art are within the spirit and scope of the present invention.

Figure 7:
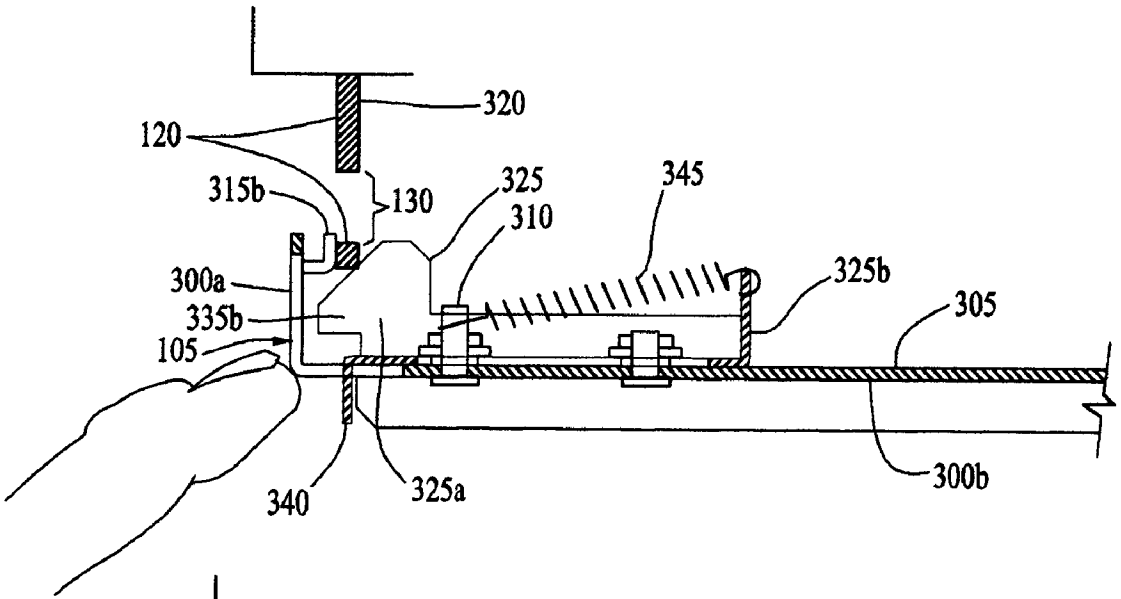
FIG. 7 is a partial cross-sectional view of the first embodiment of the bracket assembly, as revealed by the section 7—7 taken in FIG. 2 showing the bracket assembly in the process of being attached to the rail.
Figure 8:
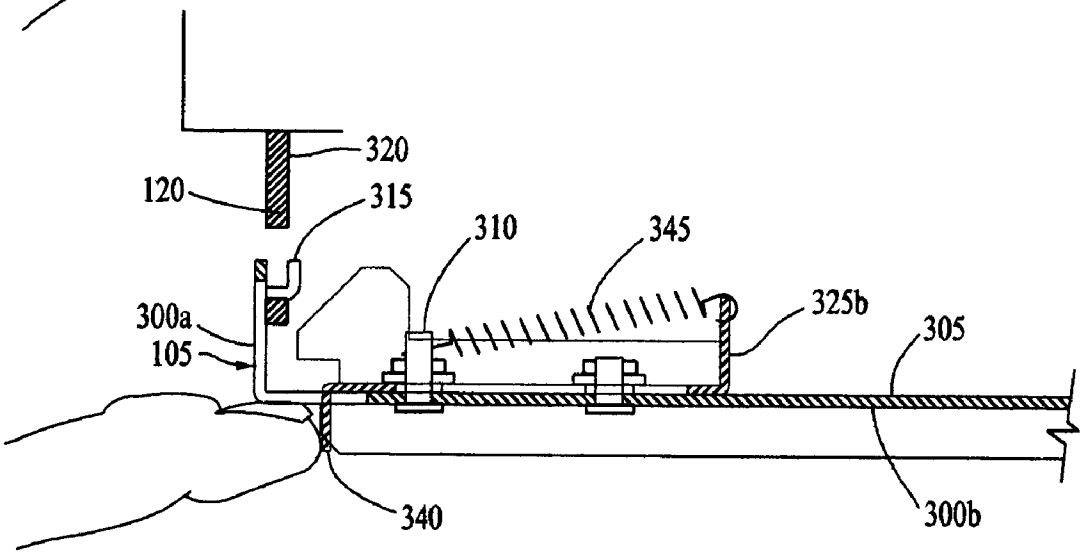
FIG. 8 is a partial cross sectional view of the first embodiment of the bracket assembly similar to FIG. 7, showing the latching assembly in a second, or unlocked, position.

As illustrated in FIGS. 6–8, the first end 325*a* of the latching assembly 325 includes a latch projection 335 configured to secure the bracket 300 and the latching assembly 325 to the rail 120, and a flange 340 that is coupled to the latch projection 335 for releasing the latch projection 335 from the rail 120. In the attached position, the latch projection 335 is wedged into the opening 130 of the rail 120 to limit the left and right movement of the bracket assembly 105. In one embodiment, the latch projection 335 has a triangle-like shape to facilitate the attachment and removal of the bracket assembly 105.

The bracket assembly 105 also includes an elastic member 345 that is coupled to the peg 310 and to the second end 325*b* of the latching assembly 325 and configured to bias the latching assembly 325 toward the end portion 300*a* of the bracket 300. In other words, the elastic member 345 maintains a pulling force on the second end 325*b* of the latching assembly 325 so that the latch projection 335 is moved toward the end portion 300*a* of the bracket 300. When the flange 340 is pushed away from the end portion 300*a* of the bracket 300, the elastic member 345 is lengthened or stretched. The elastic member 345 is preferably a coil spring, but it may be a rubber band, or any other device having elastic properties.

Referring now to FIGS. 4–6, according to a preferred first embodiment of the invention, the first end 325*a* of the latching assembly 325 includes an upper latch projection 335*a* configured to fit into one of the openings 130 of the rail 120, and a lower latch projection 335*b* configured to fit into another of the openings 130 of the rail 120. Alternatively, the latching assembly may have only a single latch projection. The bracket assembly 105 also includes a flange 340 that is coupled to the latching assembly 325 for releasing the latch projections 335*a*, 335*b* from their respective openings 130 of the rail 120. The latch projections 335*a*, 335*b* can be released from the rail 120 by moving the flange 340 away from the first section 300*a* of the bracket 300, and against the force exerted by the elastic member 345.

A front elevation view of the first exemplary embodiment of the bracket assembly 105 is illustrated in FIG. 5. The flange 340 may be positioned between the upper latch projection 335*a* and the lower latch projection 335*b*. In addition, the upper latch projection 335*a* may be positioned along a first plane that is substantially perpendicular to a second plane defined by the tabs 315*a*, 315*b*. Similarly, the lower latch projection 335*b* may be positioned along a third plane that is substantially perpendicular to the second plane.

FIG. 6 is a side view of the first embodiment of the bracket assembly 105. When the flange 340 is moved away from the end portion 300*a* of the bracket 300, the latching assembly 325 slides along the surface 305 of the bracket 300 without becoming detached from the bracket 300. Once the flange 340 is released, the elastic member 345 contracts, causing the latching assembly 325 to move toward the end portion 300*a* of the bracket 300.

FIG. 7 is a cross-sectional view, as taken along lines 7—7 of FIG. 2, of the bracket assembly 105 showing the attachment of the first embodiment of the bracket assembly 105 to the rail 120. The tabs 315*a*, 315*b* (only the lower tab 315*b* being shown) are positioned in front of the rail 120 at the desired height and aligned with their respective mating openings 130 in the rail 120. The tabs 315*a*, 315*b* are then inserted into their respective openings 130 of the rail 120, so that the end of the tabs 315*a*, 315*b* are positioned to contact the back surface 320 of the rail 120 (also see FIG. 3). The bracket assembly 105 is then pushed toward the rail 120 so that the latch projections 335*a*, 335*b* (only the lower latch projection 335*b* being shown) are positioned in their respective mating openings 130 of the rail 120.

The ends of the latch projections 335*a*, 335*b* are chamfered so that, as the bracket assembly 105 is pushed toward the rail 120 to seat the projections 335*a*, 335*b* in their respective rail holes 130, the latch projections 335*a*, 335*b* act as cams against the rail 120, and this camming action pushes the latching assembly 325 rearward (i.e., away from the end portion 300*a* of the bracket 300) and against the force of the elastic member 345, which thereby elongates elastically to a first elongated state.

Once the projections 335*a*, 335*b* are seated in their respective rail holes 130, the elastic member 345 restores itself to its original state, and in so doing, moves the latching assembly 325 toward the end portion 300*a* of the bracket 300 to a first or locking position in which the latch projections 335*a*, 335*b* establish a locking engagement against the end portion 300*a* of the bracket through their respective openings 130 of the rail 120, thereby locking the rail 120 between the latching assembly 325 and the end portion 300*a* of the racket 300. The force applied by the elastic member 345 retains the latch projections 335*a*, 335*b* in their respective opening 130 until the flange 340 is pushed away from the end portion 300*a* of the bracket 300. Hence, attaching the bracket assembly 105 to the rail 120 does not require any tools.

FIG. 8 is a cross sectional view, as taken along the lines 7—7 of FIG. 2, of the bracket assembly 105, showing the removal of the first embodiment of the bracket assembly 105 from the rail 120. The flange 340 is pushed away from the end portion 300*a* of the bracket 300, moving the latching assembly 325 away from the end portion 300*a* of the bracket 300 to a second or unlocked position, in which the latch projections 335*a*, 335*b* are disengaged from and moved out of their respective rail openings 130. This movement causes the elastic member 345 to elongate or stretch to a second elongated state. In the second elongated state, the elastic member 345 has a greater length than in the first elongated state. While the latch projections 335*a*, 335*b* are removed from their respective rail openings 130, the bracket assembly 105 is pulled away from the rail 120 so that the tabs 315*a*, 315*b* are detached from the back surface 320 of the rail 120. The tabs 315*a*, 315*b* are then moved away from and out of their respective rail openings 130. Thus, no tools are required to detach the bracket assembly 105 from the rail 120.

Figure 10:
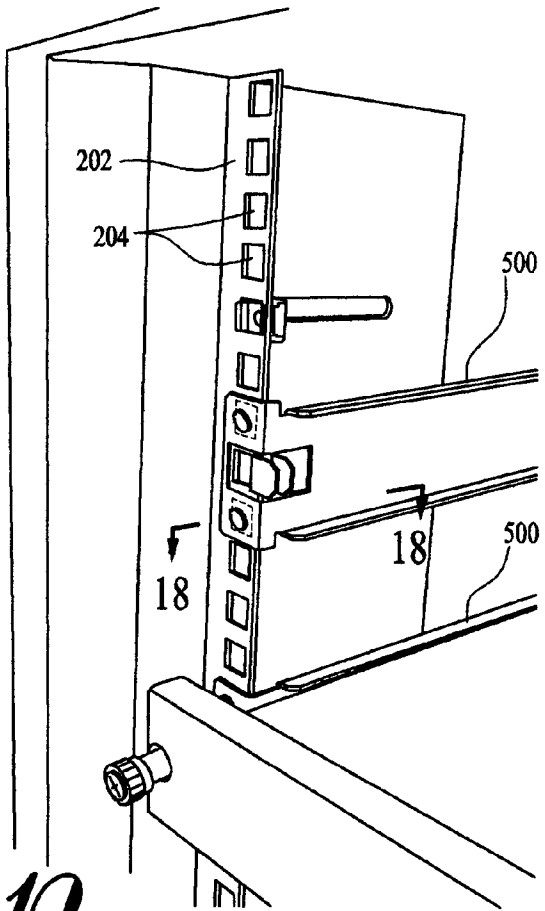
FIG. 10 is an enlarged, partial perspective view of the equipment rack of FIG. 9, showing the second embodiment of the mounting bracket assembly attached to a rail of the rack, and wherein the rail includes square apertures.
Figure 9:
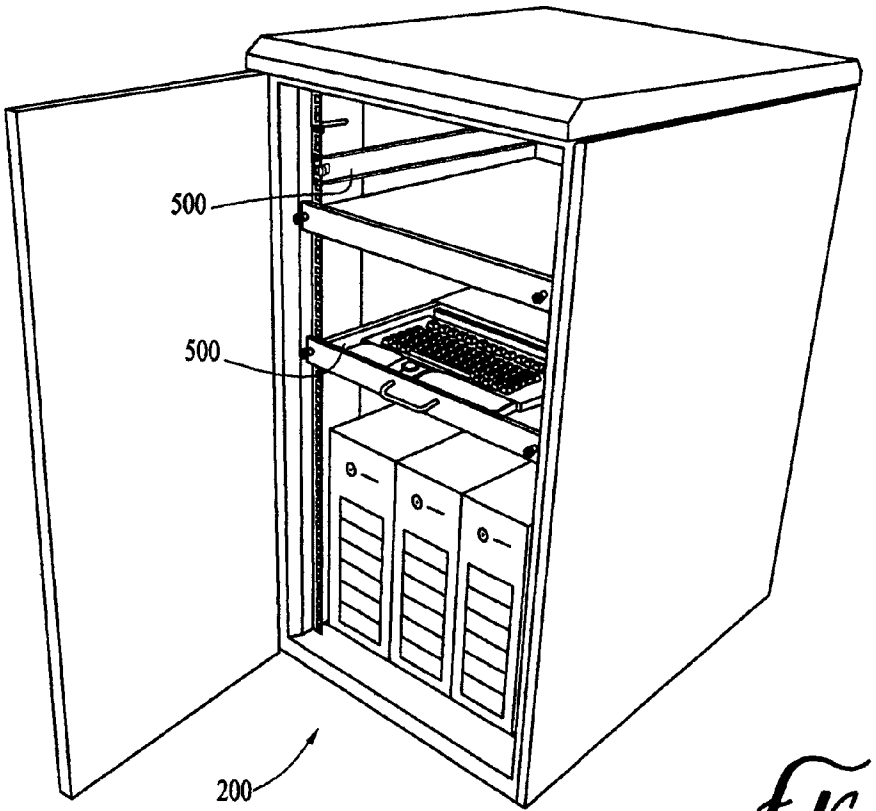
FIG. 9 is front-and-side perspective view of an equipment rack having a mounting bracket assembly in accordance with a second exemplary embodiment of the present invention.
Figure 12:
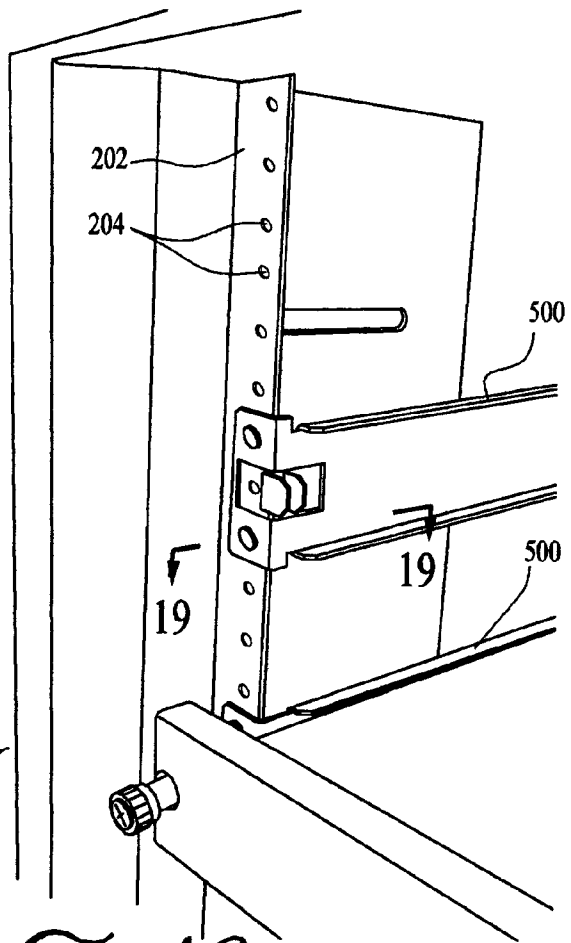
FIG. 12 is a view similar to FIG. 10, wherein the rail includes small, round, internally threaded apertures.
Figure 11:
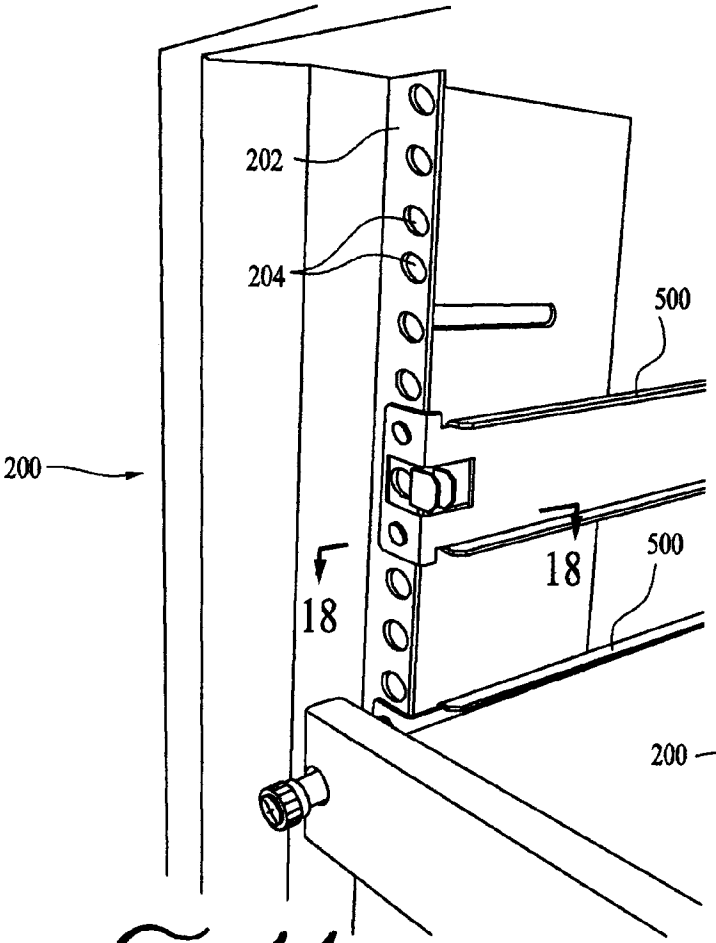
FIG. 11 is a view similar to FIG. 10, wherein the rail includes large round apertures.

A second exemplary embodiment of a mounting bracket assembly 500 in accordance with the present invention is illustrated in association with a second equipment rack 200 in the perspective view of FIG. 9. As illustrated in the enlarged perspective views of FIGS. 10–12, the equipment rack typically includes four vertical rails 202, one at each corner thereof, and each of which includes a plurality of through-apertures 204, which, by standard convention, are arranged in spaced groups of three. As is also standard in the industry, the rail apertures may be square, as illustrated in FIG. 10, or alternatively, large, round and unthreaded, as illustrated in FIG. 11, or in yet another alternative, small, round, and internally threaded, as illustrated in FIG. 12. As described in more detail below, a novel alignment pin 524 (see FIG. 17) of the second embodiment of the mounting bracket assembly enables it to be aligned and attached to any one of the standard rail configurations illustrated in the figures without the use of tools or special adjustments.

As illustrated in FIGS. 13–16, the second embodiment of the mounting bracket assembly 500 comprises an elongated, adjustable-length track assembly 502 that includes a pair of elongated, U-shaped, inner and outer tracks 504 and 506. The inner track is slightly narrower than the outer track such that it nests within the latter for relative fore-and-aft telescopic sliding movement.

In the particular embodiment illustrated, the inner track 504 includes an elongated central slot 508, and the outer track 506 includes one or more threaded apertures 510, which may comprise swaged-in nuts or nut-plates, e.g., "PEM" nuts, or the like, which are arranged to reside below the slot when the two tracks are in sliding engagement. One or more finger screws 512 or the like extend through the slot and engage the threaded apertures to hold the tracks together. Loosening the finger screw enables the length of the track assembly 502 to be adjusted to fit the depth of the equipment rack 200, and tightening the finger screws prevents further relative sliding movement between the two tracks at the selected length of the track assembly. This arrangement enables the mounting bracket assembly 500 to accommodate a wide variety of equipment rack sizes. The outer track may also include an upset, or joggle, 514 in the forward portion of its length that is equal to the thickness of the material of the outer track, and which functions to dispose the respective inner surfaces 516 of the inner track and the forward portion of the outer track, i.e., the surfaces against which a conventional, low-friction slide mechanism (not illustrated) resides, to be substantially coplanar with each other.

As illustrated in FIGS. 13–16, a right-angle flange 518 is formed at each of the rear end of the inner track 504 and the front end of the outer track 506. Each of these flanges includes a pair of circular alignment pin mounting apertures 520 disposed on either side of a central rectangular aperture 522. The centers of the alignment pin mounting apertures are spaced by a distance that is equal to the distance between the centers of the first and third rail apertures 204 in a group of three thereof.

Figures 13, 14, 15, 16, 17:
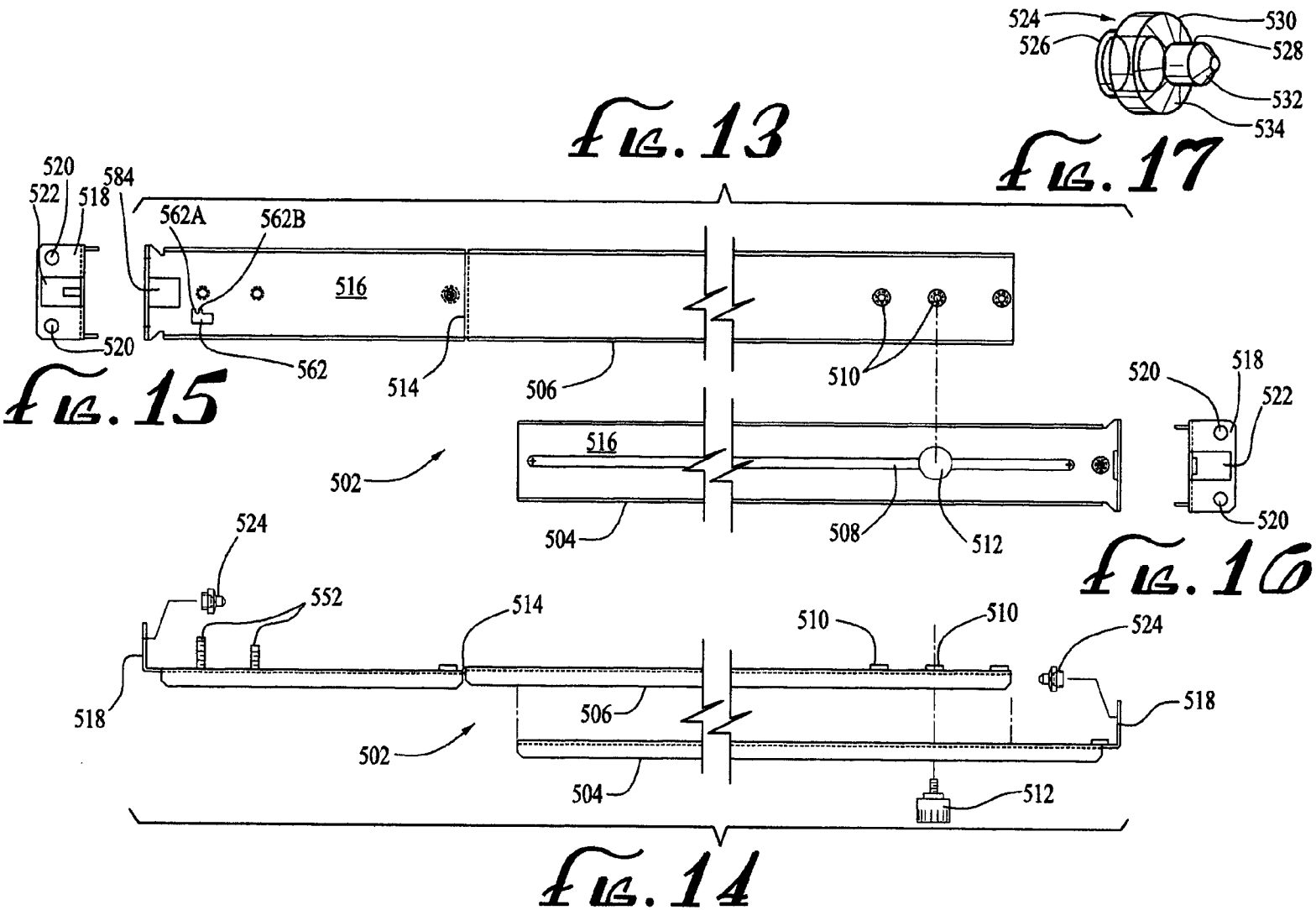
FIG. 13 is an exploded side elevation view of a track assembly of the second embodiment of the bracket assembly.
FIG. 14 is an exploded top plan view of the track assembly of the second embodiment of the bracket assembly.
FIG. 15 is a front elevation view of an outer track of the track assembly of the second embodiment of the bracket assembly.
FIG. 16 is a rear elevation view of an inner track of the track assembly of the second embodiment of the bracket assembly.
FIG. 17 is a perspective view of an alignment pin of the second embodiment of the bracket assembly.

An alignment pin 524, such as that illustrated in FIG. 17, is mounted in each of the circular apertures of the flanges, with the alignment pins arranged in inward-facing, opposed pairs, as illustrated in FIG. 14. In the particular exemplary embodiment illustrated, the alignment pins include an annular shoulder 526 on the rear of the pin that is swaged into a respective flange aperture 520 to hold the pin in place, but as those of skill in the art will appreciate, other alignment pin mounting techniques may be used in lieu of that illustrated.

Each alignment pin comprises a pair of tandem, concentric cylinders 528 and 530. The smaller cylinder 528 has a diameter sized to slide into one of the small, round, internally threaded rail apertures 204, as illustrated in FIG. 12, without turning, i.e., without engaging the threads thereof. The larger cylinder 530 has a diameter that is sized to slide into one of either the square rail apertures, as illustrated in FIG. 10, or alternatively, the large, round and unthreaded rail apertures, as illustrated in FIG. 11. The smaller cylinder includes a conical leading tip 532 and the larger cylinder includes a shoulder 534 that tapers into the smaller cylinder, each of which features functions to center the respective cylinders as they engage their respective corresponding rail apertures. This "universal" alignment pin feature enables the second embodiment of the mounting bracket assembly 500 to accommodate a wide variety of equipment racks 200, regardless of the particular configuration of their rail apertures.

As illustrated in FIGS. 21–24, the second embodiment of the mounting bracket assembly 500 is made removably attachable to the equipment rack 200 by the provision of a single, quick-release latching assembly 540 mounted on an outer surface 542 of the front end of the outer track 506 of the track assembly 502. The latching assembly comprises a carrier 544 having upstanding flanges at each of its sides and ends, a cam plate 546 slidably disposed over the carrier, and an elongated latching spring 548 slidably sandwiched between the carrier and the cam plate. The carrier and cam plate each includes one of a pair of corresponding elongated central slots 550. A pair of spaced, threaded studs 552 upstanding from the exterior surface of the outer track 506 (see also FIG. 14) extends through both slots, and a nut and washer on each stud captivate the carrier and cam plate for fore-and-aft sliding movement, both relative to the outer track and to each other, as described in more detail below.

The upstanding flange 554 at the rear end of the carrier 544 includes a pair of openings into each of which is secured a respective first end of a pair of tension springs 556. In the particular embodiment illustrated, the tension springs comprise coil springs, but other resilient tensioning elements may be used in lieu thereof. A second end of both springs is secured to the front one of the threaded studs 552 such that the springs straddle the rear one of the studs. Displacement of the carrier away from the front end of the outer track 506 thus results in a tension force in the springs that forcefully urges the carrier back toward the front end of the track.

Figures 18, 19, 20:
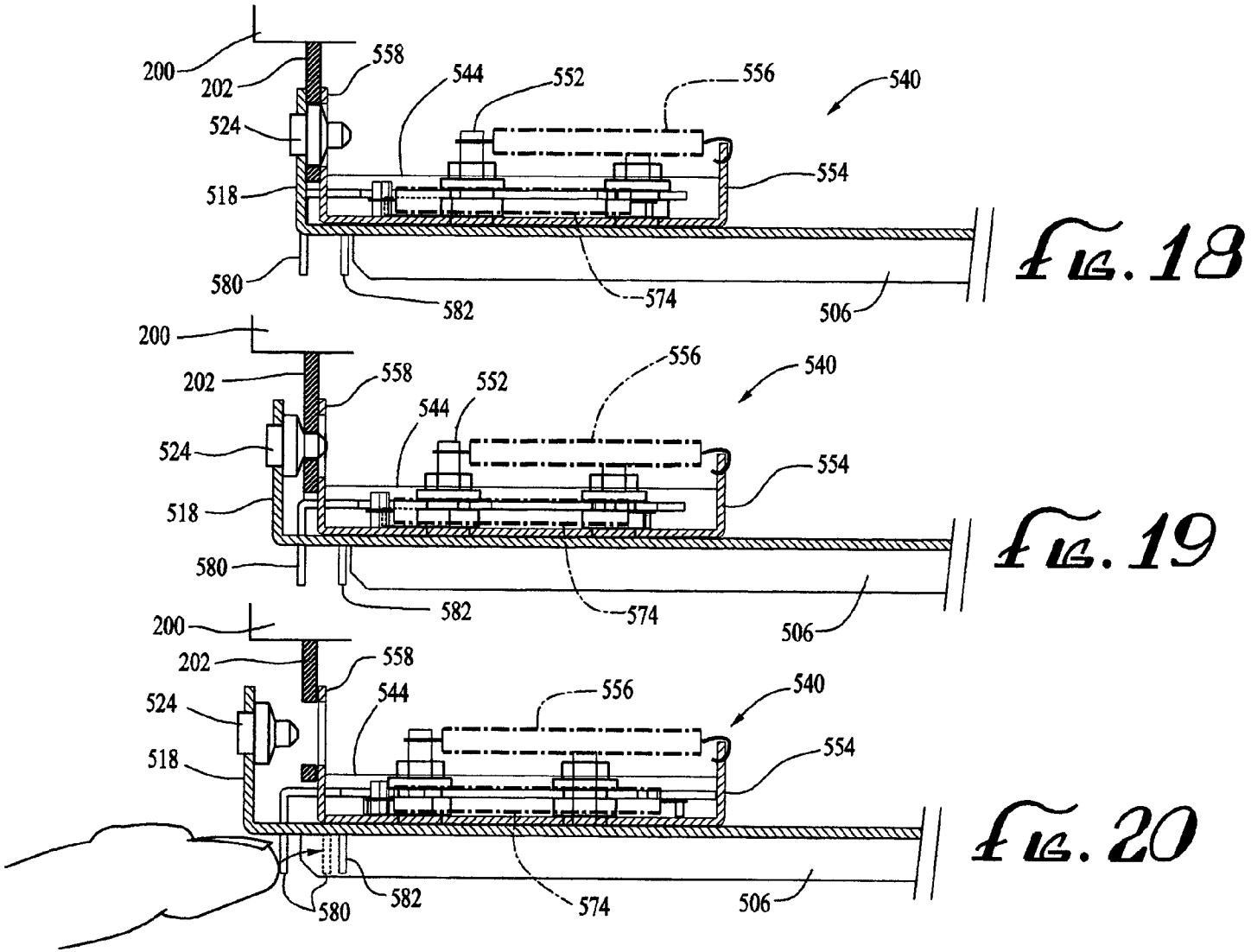
FIG. 18 is a partial cross-sectional view of the second embodiment of the bracket assembly, as revealed by the section 18—18 taken in FIG. 11, showing the bracket assembly attached to the rail, with the latching assembly in a first locking position.
FIG. 19 is a partial cross-sectional view of the second embodiment of the bracket assembly, as revealed by the section 19—19 taken in FIG. 12, showing the bracket assembly attached to the rail, with the latching assembly in a second locking position.
FIG. 20 is a partial cross sectional view of the second embodiment of the bracket assembly similar to FIG. 18, showing the latching assembly in the second, or unlocked, position.
Figure 23:
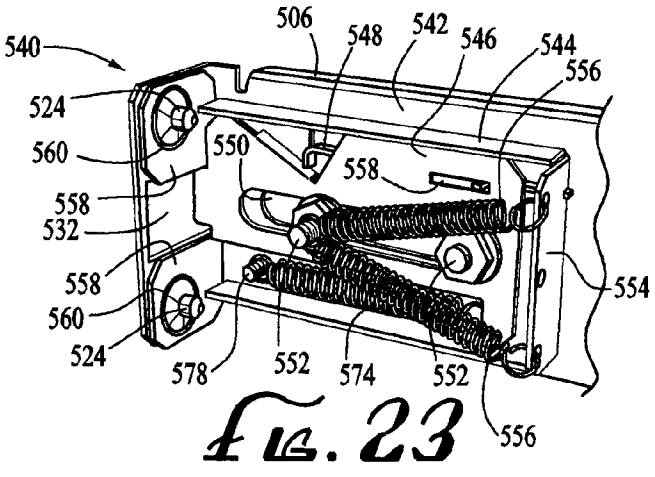
FIG. 23 is a partial rear and side perspective view of the bracket assembly of FIG. 21; and, FIG. 24 is an exploded, partial top and side perspective view of a latching assembly of the second embodiment of the bracket assembly.
Figure 21:
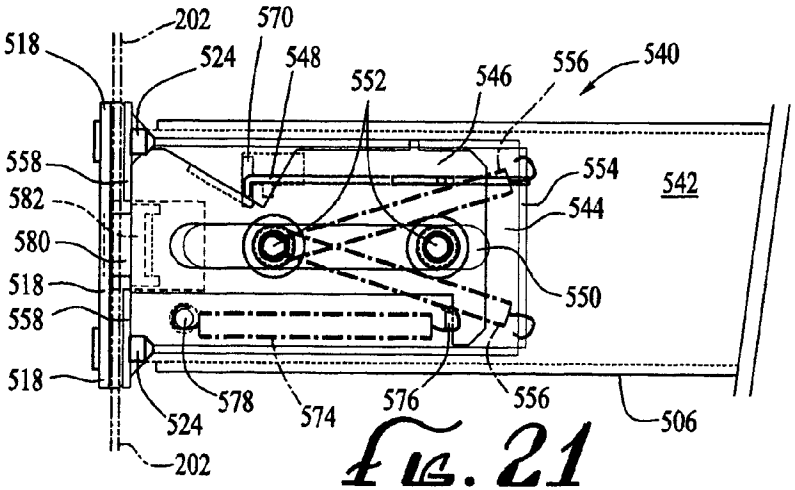
FIG. 21 is a partial side elevation view of the second embodiment of the bracket assembly of FIG. 11, showing the bracket assembly attached to the rail having large circular apertures.

Each of the upstanding flanges 558 at the front end of the carrier 544 includes an aperture 560 configured to enable an alignment pin 524 to pass through it. The two front flanges on the carrier are arranged to abut against a rear surface of one of the rails 202 of the rack such that, when the mounting bracket 500 is attached to a rack having rail apertures 202 of the type illustrated in FIGS. 10 and 11, the rail is forcefully clamped between the front flanges of the carrier and the front flange 518 of the outer track by the springs 556, as illustrated in FIGS. 18 and 21, respectively, with the front pair of alignment pins passing through a corresponding pair of the front rail apertures. Alternatively, when the mounting bracket is attached to a rack having rail apertures of the type illustrated in FIG. 12, the rail is forcefully clamped between the front flanges of the carrier and the tapered shoulders 534 of the associated front pair of alignment pins, as illustrated in FIGS. 19 and 22, respectively, with only the smaller cylinder 528 of the alignment pins extending into the rail apertures.

Figure 24:
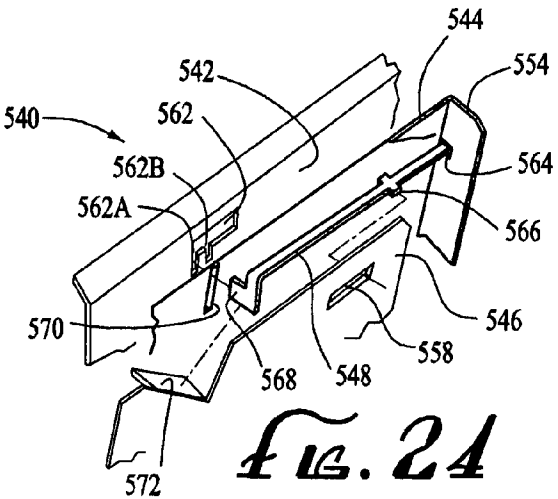
Figure 22:
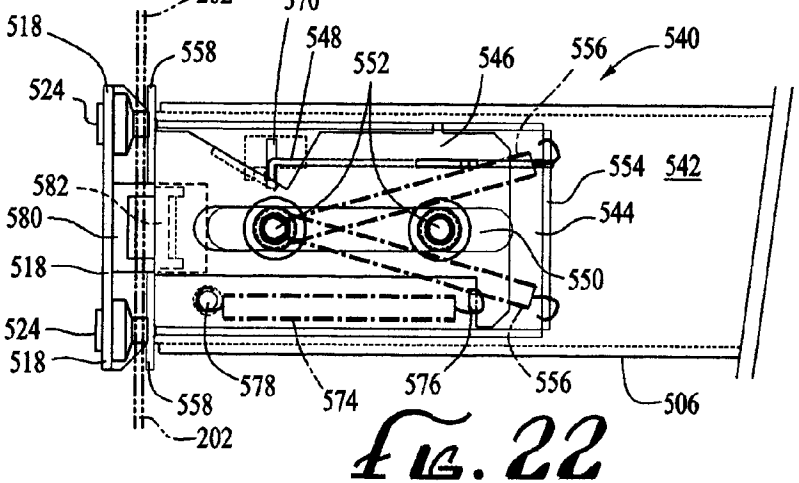
FIG. 22 is a partial side elevation view of the second embodiment of the bracket assembly of FIG. 12, showing the bracket assembly attached to the rail having small, round, threaded apertures.

It will be appreciated that, to accommodate the two foregoing attachment situations, it is desirable that the latch assembly 540 have two latching positions in which the spacing between front flanges 558 of the carrier 544 and the front flange 518 of the outer track 506 is greater than the other, as illustrated in FIGS. 18 and 21, and in FIGS. 19 and 22, respectively. To effect this, the outer track 506 includes a rectangular opening 562 (see FIGS. 13 and 24) that defines two rectangular front and rear locking notches 562A and 562B. As illustrated in FIG. 24, the latching spring 548, which may be made of a heat-treated spring steel flat stock, includes a rear end that slidably extends through an aperture 564 in the rear flange 554 of the carrier, a side finger 566 that is slidably retained in a rectangular aperture 558 in the cam plate 546, and a front end that is downwardly flanged to form a locking tab 568.

The locking tab 568 of the latching spring 548 is disposed between the carrier 544 and the cam plate 546 and extends through a slot 570 in the carrier to engage in one or the other of the two locking notches 562A, 562B in the rectangular opening 562 of the outer track 506 when the spring is in an un-deflected condition, depending on the spacing between the respective carrier and outer track front flanges 558 and 518. The cam plate includes a camming surface 572 that is disposed to engage the locking tab when moved rearward relative to the carrier, and thereby deflect the locking tab up and out of respective ones of the two locking notches. Continued rearward movement of the cam plate urges the locking tab of the spring rearward in the rectangular opening of the outer track. The cam plate is biased toward the front end of the carrier by a third tension spring 574 having a first end affixed to a tab 576 on the cam plate and a second end affixed to an upstanding stud 578 on the carrier. Thus, when the cam plate is displaced rearward relative to the carrier, the third spring is tensioned, and when the rearward force acting on the cam plate is removed, the spring functions to return the cam plate to its initial position relative to the carrier.

Each of the cam plate 546 and the carrier 544 includes a respective push tab 580 and 582 at its respective front end that are formed to extend inwardly through a rectangular opening 584 (see FIG. 13) in the outer track 506 at its front end, as shown in FIGS. 18–20. As illustrated in these figures, the second embodiment of the mounting bracket assembly 500 is attached to a pair of front and rear rails 202 of an equipment rack 200 in the following manner. First, the finger screw 512 clamping the inner and outer tracks 504 and 506 together are loosened, such that the length of the track assembly 502 can be adjusted. The pair of alignment pins 524 on the rear end flange 518 of the inner track are then inserted into a selected pair of apertures 204 in the rear rail 202. The front end of the outer rail is adjusted forward until the ends of the front pair of alignment pins on the flange 518 at the front end thereof are disposed just outside the front rail. The finger screw clamping the inner and outer tracks is then tightened temporarily to prevent further relative movement between the two tracks.

The push tab 580 of the cam plate 546 is then displaced rearward with a finger until it contacts the push tab 582 of the carrier 544. At this point, the camming surface 572 of the cam plate engages the locking tab 568 of the latching spring 548 and lifts the tab out of engagement with the front locking notch 562A of the outer track 506. Further rearward displacement of the cam plate push tab then displaces the entire latching assembly 540 rearward with respect to the outer track, until a relatively wide space is created between the carrier front flanges 558 and the outer track front flange 518, as illustrated in FIG. 20.

The latching assembly 540 is then placed over the front rail 202 such that the rail is disposed in the wide space between the front flange 558 of the carrier 544 and the front flange 518 of the outer track 506, with the front pair of alignment pins 524 disposed immediately in front of the corresponding pair of rail apertures 204 selected for bracket mounting. The rearward finger pressure on the cam plate push tab 580 is then relaxed, causing the springs 552 and 574 to urge the latching assembly forward on the outer track 506 until the front flanges of the carrier abut against the rear surface of the front rail. The finger screw 512 clamping the inner and outer tracks together is then loosened, causing the front flanges of the carrier and outer track to be pulled together forcefully on the front rail, with the front alignment pins engaged in corresponding ones of the front rail apertures, as illustrated in FIGS. 18 and 19.

In equipment racks 200 with large square or round rail apertures 204, such as those illustrated in FIGS. 10 and 11, the alignment pins 524 extend completely through the apertures, and the space between the respective front flanges 558 and 518 of the carrier 544 and the outer track 506 is equal to the thickness of the front rail 202, as illustrated in FIG. 18. In this case, as the front flanges of the carrier and the outer track come together against the rail, the camming surface 572 of the cam plate 546 releases the locking tab 568 of the latching spring 548 to engage the front locking notch 562A of the outer track, thereby locking the latching assembly 540 in place at the desired position. The finger screw 512 is then re-tightened to clamp the inner and outer tracks 504 and 506 of the track assembly 502 together at the installed length.

In equipment racks 200 with small, round, threaded rail apertures 204, such as that illustrated in FIG. 12, only the small cylinders 528 of the alignment pins 524 extend through the rail apertures, as described above, and consequently, the space between the respective carrier 544 and outer track 506 front flanges 558 and 518 is equal to the thickness of the front rail 202, plus the length of the large cylinder 530 and tapered shoulder 534 of the alignment pins, as illustrated in FIG. 19. In this case, as the front flanges of the carrier and the outer track come together against the rail, the camming surface 572 of the cam plate 546 releases the locking tab 568 of the latching spring 548 such that it engages the rear locking notch 562B of the outer track 506, thereby locking the latching assembly 540 in place at the desired position, and with the appropriate additional spacing between the respective front flanges of the carrier and the outer track provided. As above, the finger screw 512 is then re-tightened to clamp the inner and outer tracks of the track assembly 502 together at the installed length.

From the foregoing description, it may be seen that the second embodiment of the mounting bracket 500 can be easily adapted to a wide variety of equipment mounting racks 200 in terms of size and rail aperture configurations, and further, that the mounting bracket can be easily attached to, removed from, and adjusted within a given rack with the use of the fingers of a single hand only, and without the need for tools or other implements.

The mounting bracket assembly of the invention has been disclosed in detail in connection with various embodiments thereof. Although the invention has been described in terms of certain preferred embodiments thereof, other embodiments will be apparent to those of ordinary skill in the art from the disclosure herein. For example, the bracket assembly can include one or more of the elements described herein and can be configured in a variety of shapes and sizes while still maintaining the spirit and scope of the present invention. Additionally, other combinations, omissions, substitutions and modifications will be apparent to the skilled artisan in view of the disclosure herein. Accordingly, the present invention is not intended to be limited by the description of the preferred embodiments, but is to be defined by reference to the appended claims and their functional equivalents.

What is claimed is:

1. A bracket assembly for removable attachment to a rail having an aperture, a front surface, and a back surface, the bracket assembly comprising:

a bracket having a longitudinal track assembly having a first right angle flange at a first end thereof;

a rail engagement element on the first flange, configured and located so as to enter the aperture in the rail when the first flange is disposed adjacent the front surface of the rail;

a carrier having a longitudinal slot and a second right angle flange at a first end thereof, the carrier being slidably mounted on the longitudinal track assembly by means of a stud extending from the track assembly into the slot for relative longitudinals sliding movement thereon between a first position in which the second flange is proximate the first end of the longitudinal track and a second position in which the second flange is displaced away from the first end of the longitudinal track assembly; and a biasing element coupling the carrier to the longitudinal track assembly so as to bias the second flange toward the first position so as to secure the rail between the first and second flanges, with the rail engagement element being configured for entry into the aperture.

2. The bracket assembly of claim 1, wherein the biasing element is an elastic element.

3. The bracket assembly of claim 1, wherein the biasing element is a spring.

4. The bracket assembly of claim 1, wherein the rail engagement element is an alignment pin.

5. The bracket assembly of claim 4, wherein the alignment pin comprises a first cylindrical portion having a first diameter and a second cylindrical portion concentric with the first cylindrical portion and having a second diameter greater than the first diameter.

6. The bracket assembly of claim 1, further comprising:

a cam plate slidably captivated on the carrier for relative longitudinal sliding movement thereon; and an elongated latching spring captivated between the cam plate and the carrier for longitudinal sliding movement therebetween, the latching spring having a locking tab that is engagable with a locking notch in the longitudinal track assembly.

7. The bracket assembly of claim 6, wherein the cam plate includes a camming surface arranged thereon such that rearward displacement of the cam plate causes the camming surface to engage the locking tab of the locking spring and disengage it from the locking notch.

8. The bracket assembly of claim 6, further comprising a spring having a first end attached to the carrier and a second end attached to the cam plate and arranged to return the cam plate to a first position relative to the carrier when the cam plate is displaced from said first position.

9. The bracket assembly of claim 6, wherein each of the carrier and the cam plate has a right-angle push tab disposed at a respective front end thereof.

10. An equipment shelf mounting bracket assembly for use with an equipment rack of a type that includes opposing pairs of vertical front and rear rails, the rails having a plurality of through-apertures arranged in groups of three for positioning the shelf at a selected height within the rack, the mounting bracket assembly comprising:

a track assembly, including a pair of elongated, U-shaped, inner and outer tracks, the inner track nesting within the outer track for relative longitudinal telescopic sliding movement therein, the outer track having a stud extending from an exterior surface of the outer track opposite the inner track;

means for clamping the inner track to the outer track at a selected length of the track assembly and thereby preventing relative longitudinal movement between the two tracks;

a first right-angle flange disposed at each of a respective one of a rear end of the inner track and a front end of the outer track;

a pair of elongated, axially symmetrical alignment pins mounted on each of the first flanges, each pin having center and being arranged in inward-facing opposition to a corresponding pin on the opposite first flange, and with the centers of the pins in respective ones of the pairs being spaced at a distance that is equal to the distance between respective centers of two of the rail apertures in a selected group of said groups of three thereof; and a latching assembly, including (a) a carrier having a longitudinal slot through which the stud extends and slidably captivated on the outer track by the stud for relative longitudinal sliding movement on the outer track, and having a second right angle flange at a front end thereof; and (b) biasing means for urging the second flange of the carrier toward the first flange at the front end of the outer track so as to secure the rail between the second flange of the carrier and the first flange at the front end of the outer track, with each of the pins being adapted to be disposed in a corresponding one of the rail apertures.

11. The mounting bracket assembly of claim 10, further comprising another second right angle flange at an end of the carrier opposite to the front end thereof, and wherein the biasing means comprises at least one spring having a first end connected to the second flange of the carrier and a second end connected to the stud.

12. The mounting bracket assembly of claim 11, further comprising:

a cam plate slidably captivated on the carrier for relative longitudinal sliding movement thereon; and an elongated latching spring captivated between the cam plate and the carrier for longitudinal sliding movement therebetween, the latching spring having a locking tab that is engagable with at least one locking notch in the outer track to prevent longitudinal movement of the carrier thereon.

13. The mounting bracket assembly of claim 12, wherein the cam plate includes a camming surface arranged hereon such that rearward displacement of the cam plate causes the camming surface to engage the locking tab of the locking spring and disengage it from the at least one locking notch, thereby enabling the carrier to move longitudinally on the outer track.

14. The mounting bracket assembly of claim 12, further comprising a spring having a first end attached to the carrier and a second end attached to the cam plate and arranged to return the cam plate to a first position relative to the carrier when the cam plate is displaced from said first position.

15. The mounting bracket assembly of claim 12, wherein each of the carrier and the cam plate has a right-angle push tab disposed at a respective front end thereof.

16. The mounting bracket assembly of claim 10, wherein the means for clamping comprise a finger screw extending through a longitudinal slot in the inner track and threaded into a nut plate disposed on the outer track.

* * * * *